US005950894A

United States Patent [19]

Haber

[11] Patent Number: 5,950,894

[45] Date of Patent: Sep. 14, 1999

[54] BACKPACK ASSEMBLY

[76] Inventor: Robert Haber, 1 Sherwood Dr., Larchmont, N.Y. 10538

[21] Appl. No.: 08/957,335

[22] Filed: Oct. 24, 1997

Related U.S. Application Data

[63] Continuation-in-part of application No. 08/662,917, Jun. 13, 1996, abandoned, which is a continuation-in-part of application No. 08/526,049, Sep. 8, 1995, abandoned

[60] Provisional application No. 60/000,973, Jul. 7, 1995.

[51] Int. Cl.[6] ..... A45F 3/04

[52] U.S. Cl. ..... 224/627; 224/153; 224/578; 224/579; 224/580; 224/637; 224/638; 224/639

[58] Field of Search ..... 224/209, 215, 224/153, 627, 578, 579, 580, 637, 638, 639, 901.4

[56] References Cited

U.S. PATENT DOCUMENTS

| | | | |
|---|---|---|---|
| 1,137,303 | 4/1915 | Carpenter | 224/638 |
| 1,696,191 | 3/1928 | Coulson | 224/627 |
| 2,553,275 | 5/1951 | Quilter | 224/637 |
| 4,902,262 | 2/1990 | Lunsford | 446/268 |
| 5,012,964 | 5/1991 | Falletta et al. | 224/209 |
| 5,111,981 | 5/1992 | Allen | 224/250 |
| 5,465,885 | 11/1995 | Wyatt | 224/148.2 |

FOREIGN PATENT DOCUMENTS

| | | | |
|---|---|---|---|
| 21061 | of 1890 | United Kingdom | 224/209 |

OTHER PUBLICATIONS

Journal of the American Medical Association, vol. 167, No. 7, p. 930, Oct. 1958.

*Primary Examiner*—David J. Walczak
*Assistant Examiner*—Timothy L. Maust
*Attorney, Agent, or Firm*—Gottlieb, Rackman & Reisman, P.C.

[57] ABSTRACT

A backpack assembly in which the straps are connected across the wearer's chest by a easy to connect and disconnect coupling member. Alternately, the snaps can be connected so that they extend vertically along the chest.

4 Claims, 3 Drawing Sheets

FIG.1
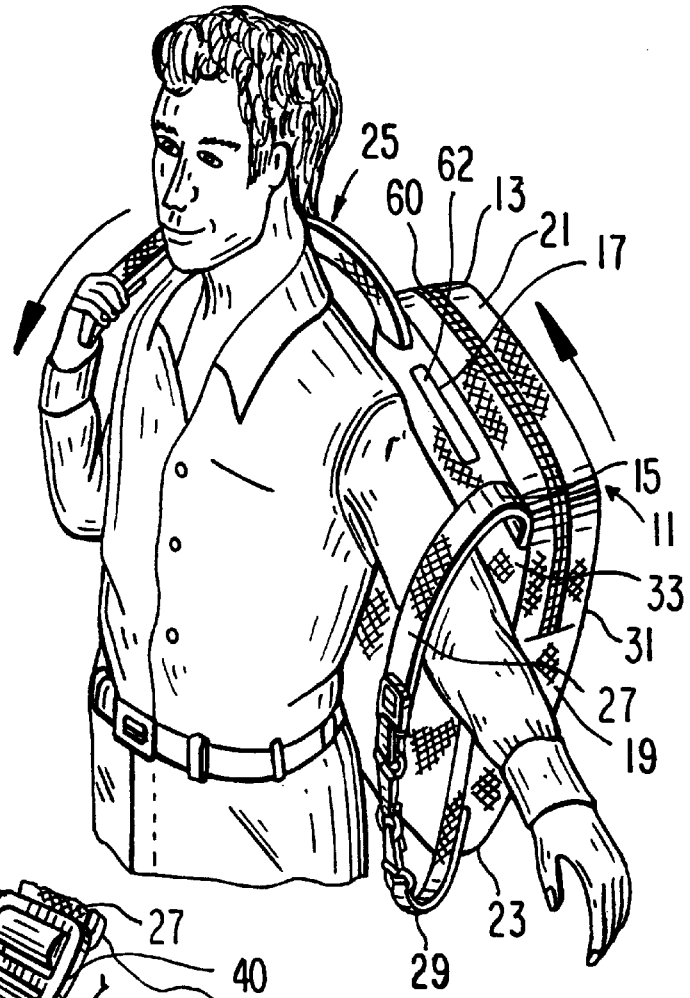
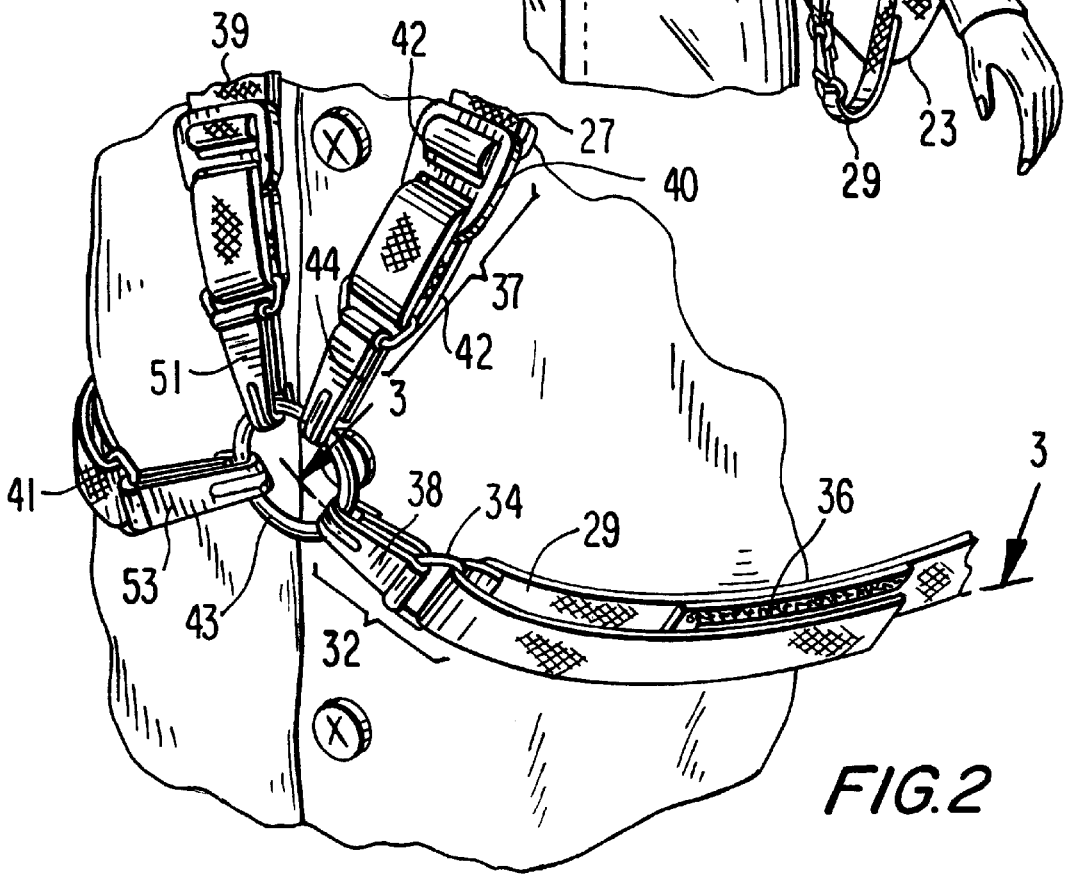
FIG.2

BACKPACK ASSEMBLY

RELATED APPLICATIONS

This application claims benefit of Provisional Application No. 60/000973 filed Jul. 7, 1995. This application is a continuation-in-part of application Ser. No. 08/662,917 filed Jun. 13, 1996, now abandoned, which is a continuation-in-part of Ser. No. 08/526,049, filed Sep. 8, 1995, now abandoned.

BACKGROUND OF THE INVENTION

A. Field of Invention

This invention pertains to backpacks, and more particularly, to a backpack which is easy to put on and take off.

B. Description of the Prior Art

Backpacks are becoming more and more popular and are used by students, people in the workplace, and by individuals in general for carrying items in a convenient manner. One problem with conventional backpack assemblies is that elderly people or individuals with certain physical and medical handicaps find it difficult to wear and remove a backpack. More specifically, these individuals find it difficult to put their arms through the strap assemblies of the backpacks without assistance, since they do require the arm to be rotated toward the rear of the body.

OBJECTIVES AND SUMMARY OF THE INVENTION

An objective of the present invention is to provide a backpack that can be put on easily by persons having limited arm movement, such as for example elderly people.

A further objective is to provide a backpack which can be manufactured easily with minimal changes from existing backpacks to reduce setup and manufacturing costs.

Yet another objective is to provide a backpack with straps that can be joined in a variety of configuration.

Generally speaking, in accordance with the invention, a backpack assembly in which upper and lower straps are provided which can be selectively coupled at a central location. In order to wear the backpack, the user or operator puts one arm through one of the straps so that the backpack is supported along the wearer's back. With one or both hands, the wearer then couples together the straps that are provided with a coupling mechanism. To remove the backpack assembly, the wearer first uncouples one strap and then slips his arm through the other strap.

In further embodiments, one or both of the straps of the backpack assembly may be adjustably sized around the shoulders of the wearer. The strap is carried through an adjustment clip and the extending portion of the strap is fastened either to the portion of the strap not extending through the adjustment clip or to the underside of the backpack—preferably, the fastening mechanism uses a hook/loop Velcro connection.

The straps are joined either by large hooks attached to a central ring or by hoop-and-loop fastening elements.

In one embodiment, two straps are joined on each side of the wearer.

BRIEF DESCRIPTION OF THE DRAWINGS

For a fuller understanding of the invention, reference is made to the following description taken in connection with the accompanying drawings, in which:

FIG. 1 is a perspective view showing the backpack assembly of the invention being put on by a wearer;

FIG. 2 shows a front view of the straps of the backpack assembly being interconnected;

DETAILED DESCRIPTION OF THE PREFERRED EMBODIMENTS OF THE INVENTION

Figure 4:
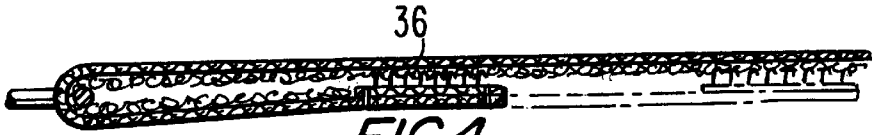
FIG. 4 shows the strap of FIG. 3 completely closed.

Referring first to FIG. 1, a backpack assembly made in accordance with the invention is generally indicated at 11. Backpack assembly 11 comprises a bag generally indicated at 13 and a pair of strap assemblies generally indicated at 15 and 25. Bag 13 is formed with a front panel 17, a rear panel 31, side panels 19, a bottom panel 23 and a top panel 21, which together define a bag interior.

As shown in FIG. 1, strap assembly 15 of backpack assembly 11 comprises an upper shoulder strap 27 and a lower shoulder strap 29 to which the upper strap member is coupled. Upper strap 27 may include a cushioned portion (not shown) made of a padded fabric material. Upper strap 27 is sewn at one end to reinforcing fabric panel 33. As shown, the lower end of upper strap 27 includes buckle assembly 37 which is used for coupling upper strap 27 to lower strap 29 as well the other strap assembly 25 as described more fully below. As seen in FIG. 2, the buckle assembly 37 includes a buckle 40. Strap 27 is attached to one side of buckle 40. The other side of the buckle 40 is attached by a short strip 42 to a self-closing hook 44.

Figure 3:
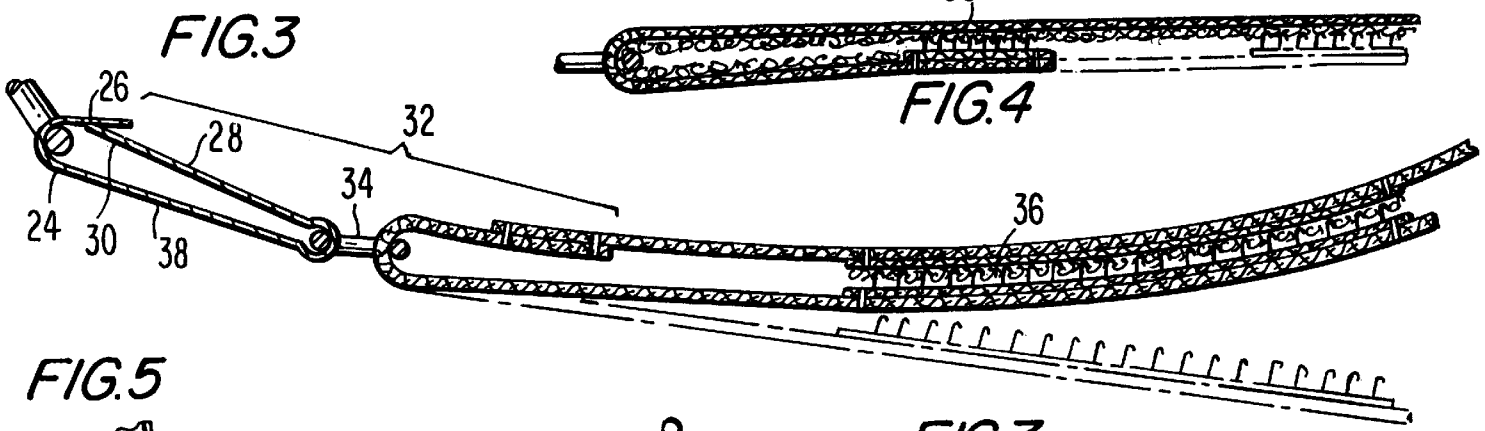
FIG. 3 is a cross-sectional view taken along line 3—3 of FIG. 2.

Lower strap 29 has a first end that is attached to the lower portion of the outside wall of rear panel 31. Lower strap 29 is also provided at the free end with a buckle assembly 32 also used to connect the strap 29 to the other straps. In addition, buckle assembly 32 and strap 29 are constructed and arranged to allow the effective length of strap 29 to be adjustable, so that strap assembly 15 may be used for various sized individuals. For this purpose, as seen more clearly in FIGS. 2–4, the buckle assembly 32 includes a loop 34 with strap 27 passing through the loop 34 as shown. Thereafter, the strap 29 doubles back on itself and is provided with a standard hook -and-loop fastener 36 disposed on the strap 29 as shown. Loop 34 is also attached to a self-locking hook 38. As best seen in FIG. 3, hook 38 includes a curved J-shaped leg 24 terminating in a free end 26. The hook 38 further includes a second leg 28 shaped so that its end 30 is biased against the free end 26. In this manner hook 38 can be opened up by pushing leg 28 inwards thereby forming a gap between the ends 26, 30. When leg 28 is released, it snaps back to the closed position shown in FIG. 3.

As shown in FIGS. 1 and 2, strap assembly 25, like strap assembly 15, comprises an upper shoulder strap 39 and a lower strap 41 substantially identical to straps 27 and 29 respectively, and terminating in respective hooks 51, 53.

Turning to FIG. 2, in one embodiment of the invention the four straps 27, 29, 39, 41 are all interconnected at a region disposed at the middle of the chest of the wearer. More specifically an interconnecting ring 43 is provided with the hooks 38, 44, 41 and 51 all engaging loop 43.

Initially, strap assembly 15 formed of straps 27 and 29 are interconnected by ring 43. In order for backpack assembly 11 of the invention to be carried or worn, the user first puts one arm through strap assembly 15 so that bag 13 is supported along the wearer's back. Using one hand to then grab the hook 51 and the other hand to grab the ring 43, or any other parts of the strap assembly 15. The wearer couples the hook 51 to ring 43 across his chest. Next, he grabs the hook 53 associated with lower strap 41 and connects this hook to ring 43 as well so that both strap assemblies 15, 25 are now wrapped around the user's other shoulders and are interconnected at the midpoint of the chest. It has been found that any person can carry a backpack of considerable size and weight using the structure shown and described above.

To remove backpack assembly 11, the wearer first uncouples strap members 39 and 41 of strap assembly 25 by disengaging hooks 51, 53 from ring 43. He can then remove the backpack easily.

In FIG. 1, the backpack 13 is shown with an opening 60 closed with a zipper or other similar means. In this configuration the contents of the backpack can be easily removed by a second person even while the first person is wearing the backpack 13. Alternatively, the backpack 13 may be provided with an opening 62 which is disposed on panel 17 in such a position that when the wearer has the backpack on his back, opening 62 is not accessible. In this arrangement, the contents of the backpack can be removed only after the wearer has removed it from his shoulder.

Figure 9:
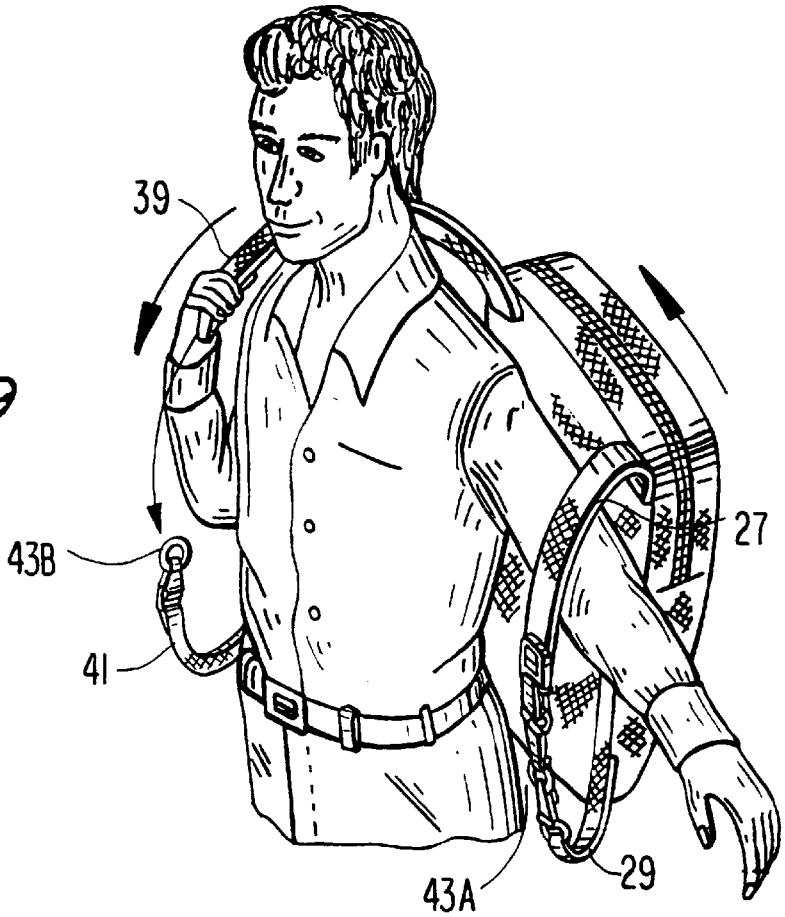
FIG. 9 shows yet another embodiment of the invention.

In FIG. 9, a configuration is shown to allow the wearer to use the backpack without the straps crossing his (or her) chest. In this configuration, two rings 43, 43A are provided, one to couple straps 27, 29 and the other to couple straps 39, 41. The wearer may have either of these rings permanently in place (dependent on whether he is left handed or right handed). To switch to the configuration of FIG. 1, one of the rings (for example 43A), may be removed and stored in the bag.

Figure 6:
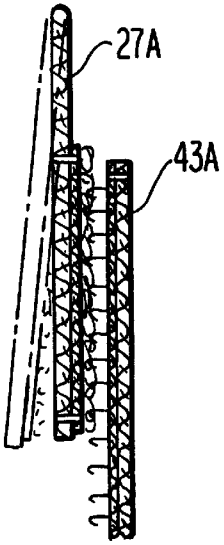
FIG. 6 is a cross-sectional view taken along line 6—6 of FIG. 5.
Figure 5:
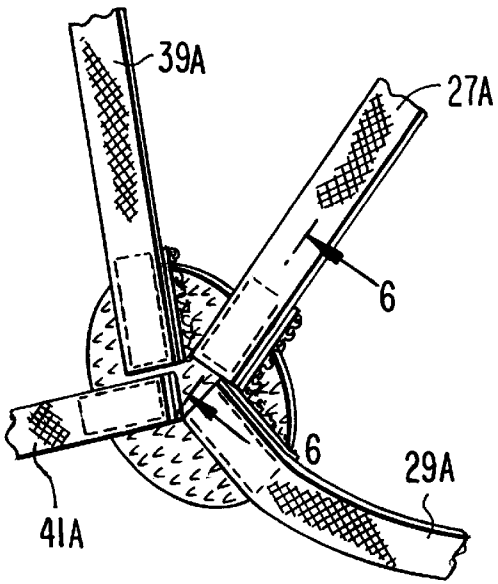
FIG. 5 shows a front view of an alternate embodiment for interconnecting the straps.

Referring now to FIG. 5, a second embodiment of a backpack coupling is formed by using hook-and-loop fasteners instead of self-locking hooks. More specifically, ring 43 is replaced by a central coupling element 43A provided on one surface with the loops. Each of the straps 27A, 29A, 39A and 41A is provided on one surface with loops used to secure the same to the central element 43A as seen in FIG. 6. Alternatively, the central element 43 may be attached permanently between two of the straps, for example straps 27A, 29A, so that only the other two straps need be coupled thereto.

Figure 8:
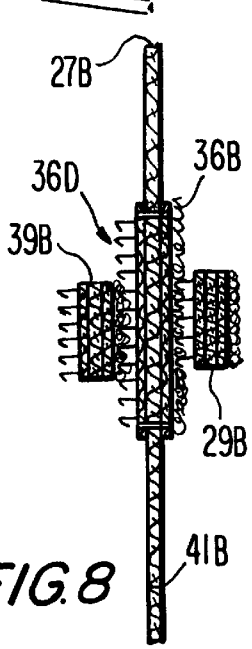
FIG. 8 is a cross-sectional view taken along line 8—8 of FIG. 7.
Figure 7:
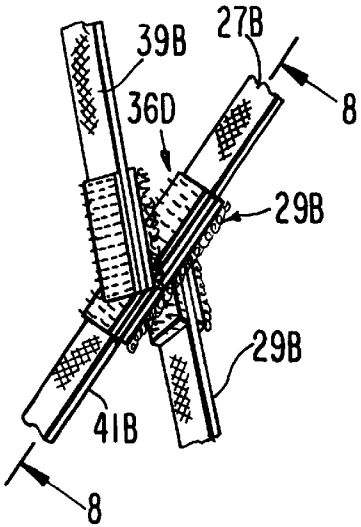
FIG. 7 is a front view of another alternate embodiment for interconnecting the straps.

In another arrangement, shown in FIGS. 7 and 8 no central coupling member is used at all. Instead, the ends of each of the straps 27B, 29B, 39B, 41B are provided one surface with loops and the other with hooks. The four straps can be coupled to each other by sandwiching one strap end on top of the other. In FIG. 8, end of strap 41B is shown with a layer of material providing the loops 36B and another layer of material providing the hooks 36D.

Figure 8A:
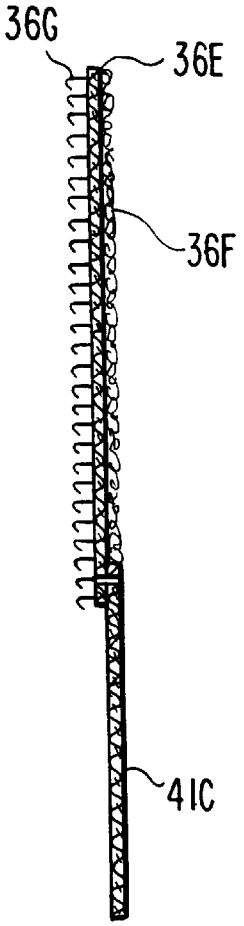
FIG. 8A shows an alternate embodiment for the strap fasteners.

In yet another embodiment shown in FIG. 8A, strap 41C is shown terminating in a single layer of material 36E, with loops 36F extending along one side of the material and hooks 36G extending on the opposite thereof.

An advantage of this invention is that the resulting backpack is very flexible in that it can be used in a number of different ways to adapt to the preferences of different users. For example, some wearers may be uncomfortable with having the straps connected across their chest. For these wearers, two connecting rings may be provided, allowing the strap assemblies 15A and 25A to be interconnected on each side of the chest, as shown in FIG. 9, independently of each other.

I claim:

1. A backpack assembly comprising:

a bag defining a bag interior and comprising a front panel and a rear panel; and a plurality of straps extending from the bag having strap surfaces; and a coupling member for coupling the ends of said straps said coupling member consisting of a plurality of hooks and loops extending normally from said strap surfaces; wherein said coupling member further includes a central member, each of said straps being connected to said central member with said hooks and loops.

2. The backpack of claim 1 wherein said central member has a surface with loops and wherein said straps have ends with hooks for coupling with said loops to form said hook-and-fastener.

3. A backpack assembly comprising:

a bag;

a first pair of straps and a second pair of straps attached to said bag; and a coupling member for connecting said straps in a configuration wherein the straps are connected to each other across the chest of the wearer, said coupling member consisting of a central member with a surface and a plurality of hooks and loops extending normally from said surface and cooperating to attach at least some of said straps to said central member.

4. The assembly of claim 3 wherein each pair of straps includes a first strap having opposed surfaces with one of said hooks and loops being disposed on both said opposite surfaces.

* * * * *